US009463475B2

(12) United States Patent
Westendarp et al.

(10) Patent No.: US 9,463,475 B2
(45) Date of Patent: Oct. 11, 2016

(54) DISCONTINUOUS CENTRIFUGE WITH A ROTATABLE CENTRIFUGE DRUM WITH A CASING AND METHOD FOR PRODUCING THE CASING

(71) Applicants: Hans-Heinrich Westendarp, Braunschweig (DE); Dirk Spangenberg, Badersleben (DE)

(72) Inventors: Hans-Heinrich Westendarp, Braunschweig (DE); Dirk Spangenberg, Badersleben (DE)

(73) Assignee: BMA Braunschweigische Maschinenbauanstalt AG, Braunschweig (DE)

( * ) Notice: Subject to any disclaimer, the term of this patent is extended or adjusted under 35 U.S.C. 154(b) by 113 days.

(21) Appl. No.: 14/236,098

(22) PCT Filed: Nov. 23, 2012

(86) PCT No.: PCT/EP2012/073464
§ 371 (c)(1),
(2) Date: Jan. 30, 2014

(87) PCT Pub. No.: WO2013/076243
PCT Pub. Date: May 30, 2013

(65) Prior Publication Data

US 2014/0256529 A1 Sep. 11, 2014

(30) Foreign Application Priority Data

Nov. 24, 2011 (DE) ..... 10 2011 119 262
Feb. 8, 2012 (DE) ..... 10 2012 002 351

(51) Int. Cl.

| | |
|---|---|
| ***B04B 3/00*** | (2006.01) |
| ***B04B 7/18*** | (2006.01) |
| ***B26F 3/00*** | (2006.01) |
| ***B04B 7/16*** | (2006.01) |
| ***B04B 11/04*** | (2006.01) |
| ***B04B 13/00*** | (2006.01) |

(52) U.S. Cl.
CPC ..... *B04B 11/04* (2013.01); *B04B 3/00* (2013.01); *B04B 7/16* (2013.01); *B04B 7/18* (2013.01); *B04B 13/00* (2013.01); *B26F 3/004* (2013.01)

(58) Field of Classification Search
CPC ..... B04B 3/00; B04B 7/04; B04B 7/08; B04B 7/16; B04B 7/18; B04B 11/04; B26F 3/004
USPC ..... 494/36, 37, 60; 451/38
See application file for complete search history.

(56) References Cited

U.S. PATENT DOCUMENTS

| | | | | |
|---|---|---|---|---|
| 4,410,318 | A | 10/1983 | Bjork et al. | |
| 5,653,815 | A * | 8/1997 | Hartmann | B01D 11/0226 127/2 |
| 2003/0085295 | A1* | 5/2003 | Dijkman | B24C 1/045 239/1 |
| 2006/0207926 | A1* | 9/2006 | Bartsch | B04B 3/00 210/360.1 |
| 2011/0003676 | A1* | 1/2011 | Collier | B01D 17/0217 494/23 |

FOREIGN PATENT DOCUMENTS

| | | | |
|---|---|---|---|
| DE | 1 916 280 | 6/1970 | |
| EP | 0 804 291 | 11/1997 | |
| EP | 696 09 594 | 12/2000 | |
| EP | 1 693 112 | 8/2006 | |
| NL | 6707505 | 4/1968 | |
| WO | WO 2004002653 A2 * | 1/2004 | B29C 70/326 |

* cited by examiner

*Primary Examiner* — Charles Cooley
*Assistant Examiner* — Shuyi S Liu
(74) *Attorney, Agent, or Firm* — Salter & Michaelson

(57) ABSTRACT

A discontinuous centrifuge has a rotatable centrifuge drum with a casing. The cylindrical centrifuge casing is provided with holes to discharge a liquid produced during the centrifugation. The holes have a cross-section with an elliptical shape. The cross-section of the holes is widened from the inside to the outside. The hole wall is continuous in this case. The diameter of the cross-sections of the holes parallel to the drum axis on the inside of the casing is equal to the diameter of the cross-sections of the holes parallel to the drum axis on the outside of the casing. The diameter of the cross-sections of the holes in the peripheral direction, on the other hand, on the inside of the casing is smaller than the diameter of the cross-sections of the holes in the peripheral direction on the outside of the casing. The area of the elliptical holes may be additionally also divided by webs.

26 Claims, 4 Drawing Sheets

DISCONTINUOUS CENTRIFUGE WITH A ROTATABLE CENTRIFUGE DRUM WITH A CASING AND METHOD FOR PRODUCING THE CASING

TECHNICAL FIELD

The invention relates to a discontinuous centrifuge with a centrifuge drum, which can be rotated about a drum axis, with a casing, in which the cylindrical centrifuge casing is provided with holes to discharge a liquid produced during the centrifugation, which holes have a cross-section with an elliptical shape.

The invention also relates to a method for producing a casing for a discontinuous centrifuge of this type. Furthermore, the invention relates to a method for operating a discontinuous centrifuge of this type.

BACKGROUND OF THE INVENTION

A centrifugal separator with radial openings is known from EP 0 804 291 B1 corresponding to DE 696 09 594 T2. The rotor of the centrifugal separator is in this case constructed with apertures in the form of radial openings in such a way that the danger of clogging or wear is reduced in the radial apertures and that, owing to a special configuration of the cross-section of the apertures, a reduction in the noise level produced and an influencing of the frequencies of the noise produced in the apertures occurs. So that this is the case, the aperture is configured in such a way that its radially inner cross-section is first of all outwardly continuous or slowly increases and then discontinuously jumps outwardly in the centre of the aperture. For this purpose, either a shape, which is first of all approximately continuous and then widens in a funnel shape, or else a transition from a continuous shape to a spherical cap or similar shape is provided. This concept may be sensible for certain applications, but has not proven to be useful to date, for example in the sugar industry.

Discontinuous centrifuges are also used, in particular, for the separation of sugar crystals from sugar crystal suspensions.

A starting material, for example a magma with an enriched crystal suspension, is fed from above, and then treated in the centrifuge drum in such a way that a product, for example a crystallisate here, is deposited on the inner surface of a casing of the centrifuge drum. The liquor, in this case, discharges through a working screen, which is located on the casing.

This crystallisate or these crystal layers then have to be cleared from the centrifuge drum so that it is ready for the next use or the next batch.

A concept of this type also to be called a periodically working centrifuge for centrifuging filling materials is already known from DE 1 916 280 B. There are provided in the centrifuge casing holes, through which the liquid separated during centrifugation from the sugar crystals is discharged to the outside and leaves the centrifuge drum.

For the cross-sectional shape of these holes, DE 1 916 280 B proposes an elliptical shape for mechanical reasons, as this is advantageous for stability. These considerations have been confirmed. The stresses in the centrifuge casing in the region of the openings are reduced in this way and therefore the durability and stability of the entire centrifuge drum are improved.

In a different form of sugar centrifuges, namely in continuously operating centrifuges, elliptical holes, in other words holes with an elliptical cross-section, are known from EP 1 693 112 B1.

In view of the large number of discontinuously working centrifuges used, specifically in the sugar industry sector, there is considerable interest in a further improvement of the centrifuge casings as well.

The object of the invention is therefore to propose a discontinuous centrifuge, which has a further optimisation of the centrifuge casing.

A further object of the invention is to disclose a method for producing a centrifuge of this type.

SUMMARY OF THE INVENTION

The object first mentioned is achieved by means of the invention in a generic discontinuous centrifuge in that the cross-section of the holes is continuous from the inside to the outside, in that the diameter ($a_2$) of the cross-sections of the holes parallel to the drum axis on the inside of the casing is equal to or approximately equal to the diameter ($a_1$) of the cross-sections of the holes parallel to the drum axis on the outside of the casing and in that the radius of the cross-sections of the holes in the peripheral direction on the inside of the casing is smaller than the radius of the cross-sections of the holes in the peripheral direction on the outside of the casing, so the cross-sections of the holes widen outwardly.

In a generic method, the object is achieved by means of the invention in that the casing, before or after the rounding of the metal casing sheet, is provided with openings in an elliptical shape by means of a water jet cut.

Surprisingly, a considerable improvement in the behaviour is possible by means of this configuration of the holes in the centrifuges, which initially appears insignificantly changed at first sight.

The reason for this is the following:

The centrifugal force brings about the centrifugal acceleration $a_Z$ on the liquid in the drum. As the liquid is, however, retained by the wall, the liquid in the perpendicular direction to the drum wall has a speed of virtually zero. If a liquid particle enters the opening, it loses contact with the rotating reference system and therefore the centrifugal acceleration also becomes zero. As the particle is not accelerated further, it requires a relatively long time to leave the drum through the opening. It is very probable that it will be pulled in by the elliptical wall opening by the rotational movement of the drum and therefore regain contact with the rotating reference system. It is constrained here to the rear opening area in the direction of rotation. The centrifugal acceleration then acts again and the particle is radially accelerated.

In order to assist the above-described effects, the opening area to the outside should therefore become greater. At the same time, a greater area, against which the liquid can "lean", is advantageous.

The introduction of outwardly widening elliptical holes of this type is first of all very laborious. It is to be taken into account here that the outward widening of the elliptical holes is not to take place to the same extent in every direction. As actually emerges from the above considerations with regard to the movement ratios of the sugar particles, it is above all a question of hole walls, which are to behave differently in different directions.

It is actually shown that the cross-sections of the holes in a dimension parallel to the drum axis should not increase from the inside to the outside, or at least not substantially. In this direction parallel to the drum axis, there is actually no movement in the centrifuge drum, or only small deflecting movements of the particles and an extension or constriction of the hole in this dimension is therefore not logical, and as it has been shown, not at all desired either.

The specification that the diameter of the cross-sections of the holes parallel to the drum axis on the inside of the casing should be equal to the diameter of the cross-sections of the holes parallel to the drum axis on the outside of the casing, is taken to mean that these two diameters should deviate by less than 5% from one another. A slight deviation, in particular a slight widening of the cross-section outwardly in this dimension as well, is still tolerable, though it should also to be as small as possible.

Instead, the widening of the cross-sections from the inside to the outside involves a dimension in the peripheral direction of the centrifuge drum, in other words at the same time in the movement direction of a rotating drum.

The wall of the hole should thus be configured differently in the various regions of the hole wall.

This is possible owing to a particularly careful machining of the metal casing sheet of the centrifuge drums by different methods.

However, it is particularly preferred if the holes are introduced into a metal casing sheet as openings by means of a water jet cut before the rounding of the metal sheet to form the cylindrical centrifuge casing.

It has actually been found that with a particularly skilled production of the centrifuge casings, a design of this type widening outwardly to a different extent, as described above, of the elliptical holes can take place particularly reliably, precisely and, at the same time, economically.

This takes place particularly advantageously when the ellipses are introduced into a metal sheet that is still flat, and this metal sheet is then rounded to form the cylinder of the drum. If the ellipse is introduced virtually perpendicularly into the metal sheet, it will receive a slightly conical shape only in one dimension during the rounding. Precisely this effect is advantageous, as the discharge of the liquid is accelerated by this. The effect can be increased in that the opening is already to a certain extent introduced "conically" into the flat metal sheet in this regard. Small angles in the range of 0.1° to 10°, preferably from 0.2 to 3°, are already sufficient to achieve great effects.

The introduction of the openings by means of an abrasive water jet cut is advantageous here, as the inclination of the cutting face with respect to the sheet metal surface can easily be adjusted and, at the same time, it can be ensured that no inclination occurs in the second dimension running perpendicular thereto.

In order to increase the discharge effect by larger areas, in a preferred embodiment, an ellipse with a web running parallel to the drum axis can also be realised in the centre, which divides the ellipse into two halves that are mutually symmetrical. This has the advantage that an additional area is produced with the web, which additionally accelerates the liquid and therefore the liquid leaves the drum more quickly. The web area preferably also slopes slightly outwardly in the direction of rotation here.

Embodiments with ellipses with more than one web also have advantages, but increase the production outlay, so no more than five webs are technically sensible.

A further effect can also be utilised owing to the configuration according to the invention of the centrifuge casing. The cross-sectional shape of the holes in the form of an ellipse favours a centring opening area, whereby fewer holes are then required overall. In comparison with a bore with a circular cross-section, with the same dimension in the axially parallel direction, the ellipse actually has many times the area. For a smaller number of holes, fewer separate working steps are required for production. For the forwarding and further processing of the fluids passing through the elliptical holes, less positions accordingly also have to be taken into account, at which the fluids discharge on the outside of the centrifuge drum.

Further preferred embodiments are given in the subclaims or are described in more detail in the description of the figures.

DESCRIPTION OF THE DRAWINGS

An embodiment of the invention will be described in more detail below with the aid of the drawings, in which.

DETAILED DESCRIPTION

Figure 1:
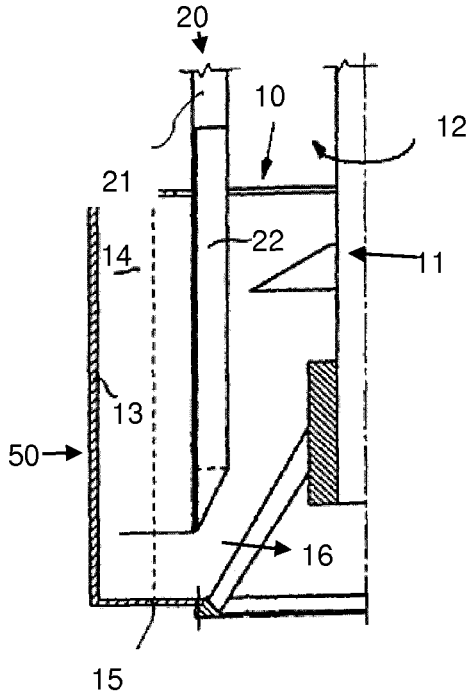
FIG. 1 shows a schematic sectional view of a discontinuous centrifuge in an embodiment of the invention, with a section vertically through the centrifuge parallel to the axis of a centrifuge drum.

In the schematic view in FIG. 1, in a vertical centre section, a centrifuge, for example a sugar centrifuge, with a centrifuge drum 10, can be seen. The centrifuge drum 10 has a drive spindle 11, which also forms the vertically arranged axis of the centrifuge drum 10 and provides the rotary drive for the entire centrifuge drum 10. In FIG. 1, the drive spindle 11 is indicated only schematically. The direction 12 of rotation is additionally marked by an arrow.

The centrifuge drum 10 furthermore has a casing 13, which is made to carry out a rotary movement by means of the rotary drive 11. The casing 13 is substantially cylindrical and covered by a working screen, not shown in more detail, on its inner wall.

A magma, which, in particular, has sugar crystals still with their mother liquor, is fed into the centrifuge drum 10. This magma is centrifuged off from the centrifuge drum 10 driven at high speed, the sugar crystals not passing through the working screen while, on the other hand, the liquor discharges through the working screen and discharges to the outside from bores 50, not shown in this Figure, in the casing 13.

After further working steps, for example washing the crystals deposited in this manner with a clean liquid, the sugar crystals in the form of a crystallisate 14 remain adhering to the inside of the casing 13 and form a type of sugar layer there.

The centrifuge drum 10 is terminated at the bottom by a base 15. The base 15 is arranged substantially perpendicular to the axis of the centrifuge drum 10. However, the base 15 has openings 16, through which the crystallisate 14 can discharge from the centrifuge drum 10 because of its gravitational force. These openings 16 are closed during the centrifuging process and only opened thereafter.

In order to be able to remove the crystallisate 14 adhering to the inner wall of the casing 13 therefrom, a removal device 20 is provided. The removal device 20 has a clearing rod 21 and an element 22 arranged on the clearing rod 21, for example a peeling knife 22 or a clearing plough. This peeling knife 22 or the clearing plough can be pivoted relative to the clearing rod about the axis formed by the clearing rod 21.

The peeling knife 22 or the clearing plough run parallel to the axis of the centrifuge drum 10 and thus vertically. They extend over the entire, or virtually the entire, height of the casing 13.

This pivoting movement leads to the peeling knife 22 being able to enter the crystallisate 14 and successively peels off the layers of crystallisate 14 there.

After the peeling process, the sugar crystals of the crystallisate 14 fall down within the centrifuge drum 10 because of their gravitational force in the direction of the base 15 and through the openings 16 there, which are now no longer closed.

Figure 2:
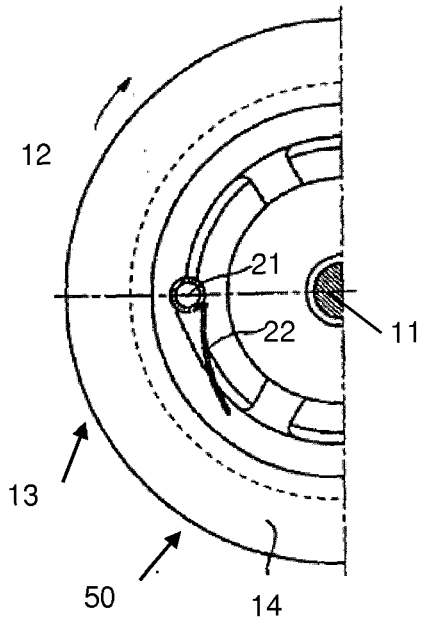
FIG. 2 shows a section through the discontinuous centrifuge from FIG. 1, taken perpendicular to the axis of the centrifuge drum.

In FIG. 2, the same situation can be seen of the same centrifuge drum 10 in a section perpendicular to the drum axis and therefore perpendicular to the drive spindle 11.

It can easily be seen that the removal device 20 with its clearing rod 21 is supplemented by an element 22 in the form of a peeling knife or clearing plough. In the position shown, this element 22 does not reach into the crystallisate 14. This position from FIG. 1 and FIG. 2 is thus adopted during the centrifugation.

The casing 13 is provided with a larger number of holes 50. These holes 50 are comparatively so small that they do not appear separately in the view in FIGS. 1 and 2.

Liquor, which escapes from the sugar crystal suspension during the centrifuging process and leaves behind the crystallisate 14, can escape outwardly through these holes 50 from the centrifuge drum 10 with the casing 13. The crystallisate 14 itself remains suspended on a screen (not shown), which is placed on the inside of the casing 13.

Figure 3:
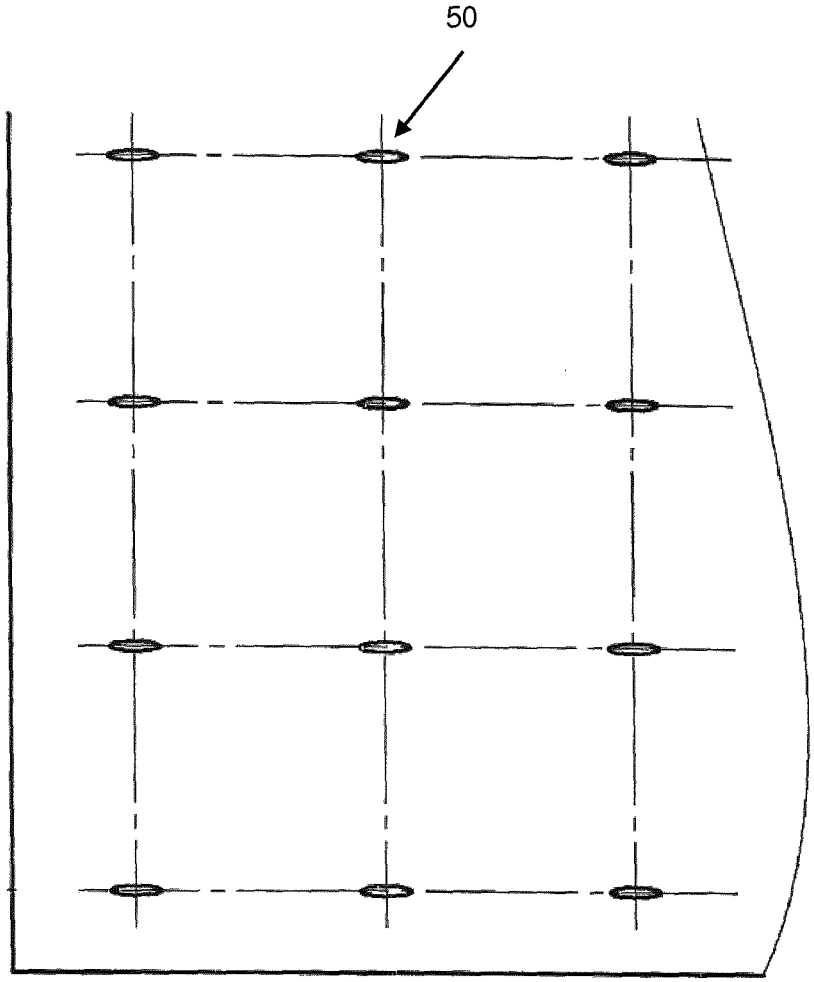
FIG. 3 shows a metal casing sheet to produce a centrifuge casing according to the invention.

FIG. 3 shows a metal casing sheet, which would be suitable to produce the casing 13 from FIGS. 1 and 2.

It can be seen that a large number of elliptical holes 50 are provided in a casing 13. The elliptical holes 50 are distributed over the metal casing sheet provided for the casing 13. A large number of possibilities are conceivable for this.

The holes 50 are, in this case, introduced into the metal casing sheet for the casing 13 by means of water jet cutting.

Figure 4A:
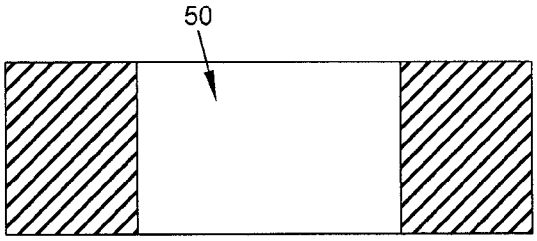
FIGS. 4A and 4B show a first example of a configuration of a hole in a centrifuge casing according to the invention.
Figure 4B:
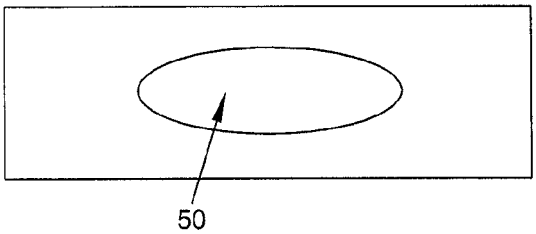

A first embodiment of a hole 50 can be seen in section at the top and in a plan view at the bottom in respective FIGS. 4A and 4B. The metal casing sheet for the casing 13 can be seen in section at the top and the region of the hole 50 can be seen in plan view in FIG. 4B.

It is seen here that the hole 50 has an elliptical shape and is introduced into the metal casing sheet by abrasive methods perpendicular to the sheet metal plane.

If the metal casing sheet is now bent in a cylindrical shape to produce the casing 13, it can well be imagined in FIGS. 4A and 4B that for example with an upward bend, the hole 50 is then compressed on the upper side and is distorted on the lower side. This process is uniform, so by means of this curvature alone, a continuous shape of the hole 50 is produced, which is open at the bottom in FIG. 4A. Further explanations with regard to this are to be found below in conjunction with the description of FIG. 7.

Figure 5A:
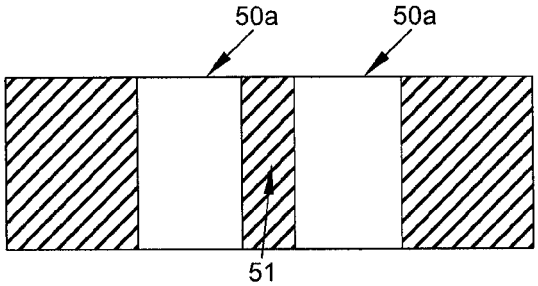
FIGS. 5A and 5B show a second embodiment of a configuration of a hole in a centrifuge casing according to the invention.
Figure 5B:
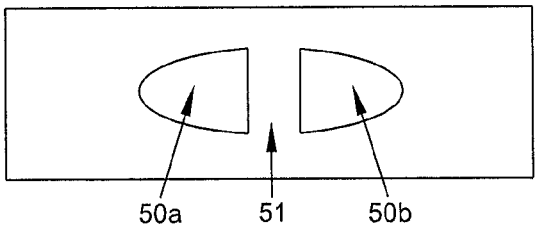

A second embodiment of a hole 50 can be seen at the top in section and at the bottom in a plan view in respective FIGS. 5A and 5B. The hole 50 is composed here of two individual regions 50*a* and 50*b*, which together form an elliptical shape with a web 51 located in between.

In the cross-section, which is shown at the top in FIG. 5A, it is shown that this embodiment is also introduced into the metal casing sheet for the casing 13 by vertical water cutting.

When this metal sheet is bent to produce the cylindrical casing 13, a shaping of the elliptical structure to be designated approximately conical in one dimension is in turn produced, similarly to in FIGS. 4A and 4B. The web is advantageously already produced to be slightly oblique (viewed in a plan view) specifically continuously sloping outwardly in the direction of rotation.

Figure 6A:
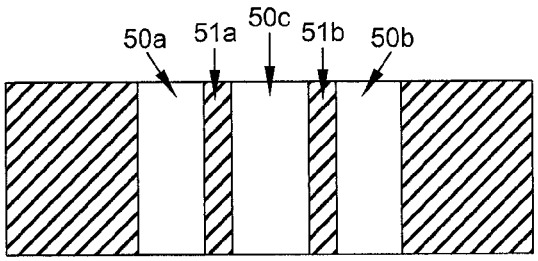
FIGS. 6A and 6B show a third embodiment of a configuration of a hole in a centrifuge casing according to the invention.
Figure 6B:
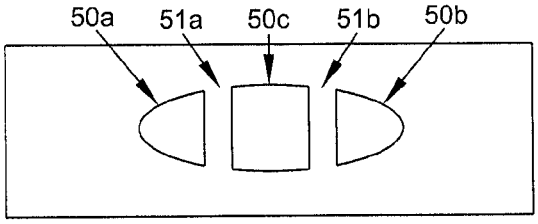

A third embodiment of a hole 50 can be seen in section at the top and in a plan view at the bottom in respective FIGS. 6A and 6B. The hole 50 is again elliptical and divided by two webs 51*a* and 51*b*, so three part holes 50*a*, 50*b* and 50*c* are formed.

Figure 7:
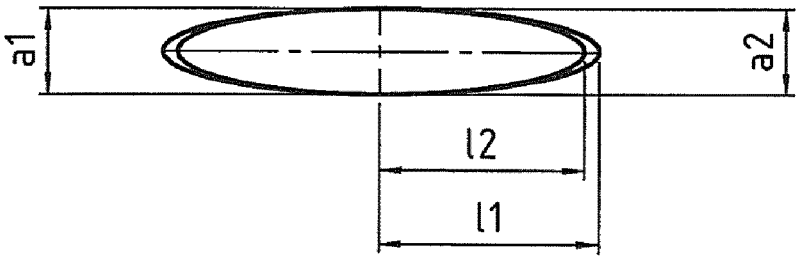
FIG. 7 shows a plan view of an embodiment similar to FIGS. 4A and 4B with a view of a three-dimensional effect.

FIG. 7 shows a plan view of an embodiment of a hole 50, which is initially similar to the view in FIG. 4 FIGS. 4A and 4B.

However, in this view, the emphasis is on another aspect. The hole 50 overall has three dimensions. The first dimension runs on the periphery of the cylinder drum and can be seen in FIG. 7 in the page plane from left to right.

A second dimension runs on the cylinder drum parallel to the drum axis and is shown from top to bottom in the page plane in FIG. 7.

A third dimension runs perpendicular to the casing 13 of the centrifuge drum 10 and is therefore perpendicular to the page plane in FIG. 7.

The casing 13 of the centrifuge drum has a finite dimension. It has an inside, which faces the drum axis, and an outside, which faces the surroundings.

Now the hole 50 has a cross-section, which is in each case constructed elliptically. The elliptical cross-section therefore has a generally smaller diameter, which extends, in the embodiment shown, parallel to the drum axis, in other words from top to bottom in FIG. 7. In this case, the diameter of the elliptical cross-section on the outside of the casing 13 is designated $a_1$ and the diameter of the elliptical cross-section on the inside of the casing 13 is designated $a_2$. As can be seen, the two diameters $a_1$ and $a_2$ are the same size and also overlap.

The second, larger diameter in the majority of the embodiments and also in the embodiment shown runs perpendicular to the first diameters $a_1$ and $a_2$ in the peripheral direction of the casing 13 and therefore from left to right in FIG. 7. Here, the cross-section of the elliptical hole 50 located on the outside of the drum casing is designated $I_1$ and the elliptical cross-section located on the inside of the casing 13 in this dimension is designated $I_2$.

It can be seen that $I_1$ is greater than $I_2$. As the hole wall continuously connects the elliptical cross-sections on the outside of the casing 13 and on the inside of the casing 13 to one another, it follows from this that the hole wall in FIG. 7 on the sides, which are at the top or bottom in the view, runs perpendicular to the page plane, while in the regions located to the left or right of the hole 50, it runs inclined to the page plane.

In connection with other aspects of the present invention, the following parameters apply:

the radii of the cross-sections of the elliptical holes in the peripheral direction is greater than the diameter ($a_1$, $a_2$) of the holes parallel to the drum axis, and that the semi-axis ratio of the ellipses is between 1:2.5 and 1:7.5, preferably between 1:4.5 and 1:5.5;

the open area of each ellipse is between 80 $mm^2$ and 150 $mm^2$, preferably between 95 $mm^2$ and 105 $mm^2$;

the holes in the casing of the centrifuge drum distributed over the drum height have a different opening cross-section;

the holes in the casing of the centrifuge drum have different spacings from one another over the height of the drum;

the material thickness of the metal casing sheet of the casing of the centrifuge drum is between 8 mm and 25 mm, preferably between 10 mm and 17 mm.

LIST OF REFERENCE NUMERALS

10 centrifuge drum
11 drive spindle of the centrifuge drum 10
12 direction of rotation of the centrifuge drum 10
13 casing
14 crystallisate on the inside of the casing 13
15 base
16 openings
20 removal device
21 clearing rod of the removal device 20
22 element, in particular peeling knife or clearing plough of the removal device 20
23 pivoting direction of the element 22 of the removal device 20
24 absorber of force and/or torque during the pivoting movement of the element 20
50 hole
50*a* part hole
50*b* part hole
50*c* part hole
51 web
51*a* first web
51*b* second web
$a_1$ diameter of the hole 50 in the vertical direction on the outside of the casing 13
$a_2$ diameter of the hole 50 in the vertical direction on the inside of the casing 13
$I_1$ radius of the hole 50 in the horizontal direction on the outside of the casing 13
$I_2$ radius of the hole 50 in the horizontal direction on the inside of the casing 13

What is claimed is:

1. Discontinuous centrifuge with a centrifuge drum, which can be rotated about a drum axis, with a cylindrical casing having inside and outside sides, in which the cylindrical centrifuge casing is provided with holes to discharge a liquid produced during the centrifugation, which holes have a cross-section with an elliptical shape having a center, the cross-section of the holes is continuous from the inside to the outside, in that the diameter ($a_2$) of the cross-sections of the respective holes parallel to the drum axis on the inside of the casing is equal to or approximately equal to the diameter ($a_1$) of the cross-sections of the holes parallel to the drum axis on the outside of the casing, in that the radius of the cross-sections of the respective holes in the peripheral direction on the inside of the casing is smaller than the radius of the cross-sections of the holes in the peripheral direction on the outside of the casing, so the cross-sections of the holes in the peripheral direction widen outwardly, and in that each hole has generally symmetrical portions on each side of said center measured in the peripheral direction with respective semi-major radii that are substantially the same.

2. Discontinuous centrifuge according to claim 1, characterised in that the elliptical cross-sections of the holes widening outwardly have hole walls with an angle relative to the perpendiculars to the casing at the outer ends of the radii in the peripheral direction of more than 0.1° and less than 10°.

3. Discontinuous centrifuge according to claim 2, characterised in that the hole walls of the holes are also continuous in the peripheral direction.

4. Discontinuous centrifuge according to claim 1, characterised in that the holes are introduced as openings into a metal casing sheet by means of a water jet cut before the rounding of the sheet metal to form the cylindrical centrifuge casing.

5. Discontinuous centrifuge according to claim 1, characterised in that the radii of the cross-sections of the elliptical holes in the peripheral direction is greater than the diameter ($a_1$, $a_2$) of the holes parallel to the drum axis, and that the semi-axis ratio of the ellipses is between 1:2.5 and 1:7.5.

6. Discontinuous centrifuge according to claim 1, characterised in that the open area of each ellipse is between 80 $mm^2$ and 150 $mm^2$.

7. Discontinuous centrifuge according to claim 1, characterised in that the holes in the casing of the centrifuge drum distributed over the drum height have a different opening cross-section.

8. Discontinuous centrifuge according to claim 1, characterised in that the holes in the casing of the centrifuge drum have different spacings from one another over the height of the drum.

9. Discontinuous centrifuge according to claim 1, characterised in that the material thickness of the metal casing sheet of the casing of the centrifuge drum is between 8 mm and 25 mm.

10. Discontinuous centrifuge with a centrifuge drum, which can be rotated about a drum axis, with a cylindrical casing having inside and outside sides, in which the cylindrical centrifuge casing is provided with holes to discharge a liquid produced during the centrifugation, which holes have a cross-section with an elliptical shape, the cross-section of the holes is continuous from the inside to the outside, in that the diameter ($a_2$) of the cross-sections of the respective holes parallel to the drum axis on the inside of the casing is equal to or approximately equal to the diameter ($a_1$) of the cross-sections of the holes parallel to the drum axis on the outside of the casing, in that the radius of the cross-sections of the respective holes in the peripheral direction on the inside of the casing is smaller than the radius of the cross-sections of the holes in the peripheral direction on the outside of the casing, so the cross-sections of the holes widen outwardly, characterised in that one, several or all the ellipses of the holes in the casing of the centrifuge drum have at least one web, which runs parallel to the drum axis, in the centre, which web divides the ellipse into two mutually symmetrical halves.

11. Discontinuous centrifuge according to claim 10, characterised in that the cross-sectional area of the webs decreases outwardly and in that the hole wall is also continuous in the region of the webs.

12. Discontinuous centrifuge according to claim 10, characterised in that the ellipse has a plurality of webs, at least two and at most five.

13. Method for producing a discontinuous centrifuge with a centrifuge drum and a casing according to claim 1, characterised in that the casing, before the rounding of the metal casing sheet, is provided with openings in an elliptical shape by means of a water jet cut, from which, after the rounding, the holes with the elliptical cross-section are formed.

14. Method for producing a discontinuous centrifuge according to claim 13, characterised in that the openings in an elliptical shape receive a conical shape by means of a water jet cut before the rounding of the metal casing sheet.

15. Method for producing a discontinuous centrifuge with a centrifuge drum and a casing according to claim 1, characterised in that the casing, after the rounding of the metal casing sheet, is provided with holes with a cross-section in an elliptical shape by means of a water jet cut, in that the walls of the holes are configured to be continuous from the inside to the outside.

16. Discontinuous centrifuge according to claim 1, characterised in that the elliptical cross-sections of the holes widening outwardly have hole walls with an angle relative to the perpendiculars to the casing at the outer ends of the radii in the peripheral direction of more than 0.1° and less than 10°, and the hole walls of the holes are also continuous in the peripheral direction.

17. Discontinuous centrifuge according to claim 1, characterised in that the elliptical cross-sections of the holes widening outwardly have hole walls with an angle relative to the perpendiculars to the casing at the outer ends of the radii in the peripheral direction of more than 0.1° and less than 10°, and the holes are introduced as openings into a metal casing sheet by means of a water jet cut before the rounding of the sheet metal to form the cylindrical centrifuge casing.

18. Discontinuous centrifuge according to claim 1, characterised in that the elliptical cross-sections of the holes widening outwardly have hole walls with an angle relative to the perpendiculars to the casing at the outer ends of the radii in the peripheral direction of more than 0.1° and less than 10°, and the radii of the cross-sections of the elliptical holes in the peripheral direction is greater than the diameter ($a_1$, $a_2$) of the holes parallel to the drum axis, and that the semi-axis ratio of the ellipses is between 1:2.5 and 1:7.5.

19. Discontinuous centrifuge according to claim 18, characterised in that the open area of each ellipse is between 80 $mm^2$ and 150 $mm^2$, and the holes in the casing of the centrifuge drum distributed over the drum height have a different opening cross-section.

20. Discontinuous centrifuge according to claim 19, characterised in that the holes in the casing of the centrifuge drum have different spacings from one another over the height of the drum and the material thickness of the metal casing sheet of the casing of the centrifuge drum is between 8 mm and 25 mm.

21. Discontinuous centrifuge according to claim 1, characterised in that the elliptical cross-sections of the holes widening outwardly have hole walls with an angle relative to the perpendiculars to the casing at the outer ends of the radii in the peripheral direction of more than 0.2° and less than 3°.

22. Discontinuous centrifuge according to claim 1, characterised in that the radii of the cross-sections of the elliptical holes in the peripheral direction is greater than the diameter ($a_1$, $a_2$) of the holes parallel to the drum axis, and that the semi-axis ratio of the ellipses is between 1:4.5 and 1:5.5.

23. Discontinuous centrifuge according to claim 1, characterised in that the open area of each ellipse is between 95 $mm^2$ and 105 $mm^2$.

24. Discontinuous centrifuge according to claim 1, characterised in that the material thickness of the metal casing sheet of the casing of the centrifuge drum is between 10 mm and 17 mm.

25. Discontinuous centrifuge according to claim 1, characterised in that the respective diameters $a_1$ and $a_2$ deviate by less than 5% from one another.

26. Discontinuous centrifuge according to claim 10, in that the elliptical shape has a center and in that each hole has generally symmetrical portions on each side of said center measured in the peripheral direction with respective semi-major radii that are substantially the same.

* * * * *